US009223234B2

(12) United States Patent
Parsapour et al.

(10) Patent No.: US 9,223,234 B2
(45) **Date of Patent: *Dec. 29, 2015**

(54) ELECTROPHOTOGRAPHIC PRINTER PHOTOCONDUCTOR BASED ON SURFACE-MODIFIED SEMICONDUCTOR QUANTUM DOTS

(71) Applicant: BROTHER INTERNATIONAL CORPORATION, Bridgewater, NJ (US)

(72) Inventors: Farzad Parsapour, Bartlett, TN (US); Rodney Loyd, Cordova, TN (US); Juzo Kuriyama, Germantown, TN (US)

(73) Assignee: BROTHER INTERNATIONAL CORPORATION, Bridgewater, NJ (US)

( * ) Notice: Subject to any disclaimer, the term of this patent is extended or adjusted under 35 U.S.C. 154(b) by 44 days.

This patent is subject to a terminal disclaimer.

(21) Appl. No.: 14/174,156

(22) Filed: Feb. 6, 2014

(65) Prior Publication Data

US 2015/0220008 A1 Aug. 6, 2015

(51) Int. Cl.

| | |
|---|---|
| ***G03G 5/00*** | (2006.01) |
| ***G03G 5/087*** | (2006.01) |
| ***G03G 5/04*** | (2006.01) |
| ***G03G 5/153*** | (2006.01) |
| ***G03G 15/00*** | (2006.01) |

(52) U.S. Cl.

CPC ..... *G03G 5/087* (2013.01); *G03G 5/00* (2013.01); *G03G 5/04* (2013.01); *G03G 5/153* (2013.01); *G03G 15/75* (2013.01); *G03G 2215/00957* (2013.01)

(58) Field of Classification Search

CPC ..... G03G 5/04; G03G 5/153
USPC ..... 430/59.1, 135
See application file for complete search history.

(56) References Cited

U.S. PATENT DOCUMENTS

| | | | | |
|---|---|---|---|---|
| 5,889,288 | A | 3/1999 | Futatsugi | |
| 5,923,046 | A | 7/1999 | Tezuka et al. | |
| 5,963,571 | A | 10/1999 | Wingreen | |
| 6,239,449 | B1 | 5/2001 | Fafard et al. | |
| 6,281,519 | B1 | 8/2001 | Sugiyama et al. | |
| 7,282,732 | B2 | 10/2007 | Gray et al. | |
| 7,358,525 | B2 | 4/2008 | Lee | |
| 7,791,157 | B2 | 9/2010 | Cho et al. | |
| 7,829,880 | B2 | 11/2010 | Ebe et al. | |
| 8,164,083 | B2 | 4/2012 | Parsapour | |
| 8,765,338 | B2 * | 7/2014 | Parsapour et al. | 430/59.1 |
| 2003/0066998 | A1 | 4/2003 | Lee | |
| 2009/0212258 | A1 | 8/2009 | McCairn et al. | |
| 2013/0049738 | A1 | 2/2013 | Sargent | |

OTHER PUBLICATIONS

International Search Report and a Written Opinion for PCT/IB2012/000610 dated Aug. 17, 2015.

* cited by examiner

*Primary Examiner* — Mark A Chapman
(74) *Attorney, Agent, or Firm* — Frommer Lawrence & Haug LLP

(57) ABSTRACT

A photoconductor and method of forming a photoconductor comprising forming a charge generation material comprising a plurality of quantum dots, and forming an active region comprising one or more photoconductor layers comprising the charge generation material including the surface modified quantum dots is disclosed.

16 Claims, 6 Drawing Sheets

◇ : QD (CGM)
▲ : Hole Transport Material (HTM)
● : Electron Transport Material (ETM)
▥ : Polymer Matrix

◇ : QD (CGM)

▲ : Hole Transport Material (HTM)

⬢ : Electron Transport Material (ETM)

▩ : Polymer Matrix

ELECTROPHOTOGRAPHIC PRINTER PHOTOCONDUCTOR BASED ON SURFACE-MODIFIED SEMICONDUCTOR QUANTUM DOTS

BACKGROUND OF THE INVENTION

Electrophotographic printing is a non-impact printing technology invented by Chester Carlson in the 1930s. It occupies a large segment of the total printing market, with a global market value of $59.9 billion as of 2009. Electrophotographic printing is a highly complex printing technology consisting of 2 core components, namely the photoconductor (PC) and the toner. The printing process involves 7 distinct steps, which include PC charging, PC exposure, toner development, toner transfer, fusing, cleaning, and charge erasure. The photoconductor, as a primary component, is involved in 6 of the 7 aforementioned steps. Thus, both photoconductor durability and performance are highly sought-after characteristics.

An example of a process applied for forming images by electrophotography using these photoconductors is the Carlson process, named after Chester Carlson. In this process, image formation is carried out by charging the photoconductor by corona discharge in the dark, forming an electrostatic latent image such as characters or pictures of a copy on the surface of the charged photoconductor, developing the formed electrostatic latent image with toner, and fixing the developed toner image on a carrier such as paper, and following transfer of the toner image, the photoconductor is reused after carrying out erase, removal of residual toner and optical erase.

The photoconductor is the component through which a latent image can be formed, with the latent image being developed by toner particles in the subsequent step. Initially, an electrostatic charge is distributed through projection on the surface of the PC. Next, light exposure results in generation of charge carriers within the PC and through absorption of light by the CGM. The charge carriers are transported to the PC surface and the opposite electrode by a CTM. As the charge carriers reach the surface, they neutralize surface charges within the area previously illuminated. This forms a latent image on the surface of the PC, which can then be subjected to toner development.

Photoconductor performance relies on several factors, including charge acceptance during projection of charge on PC surface, free charge generation and transport following illumination, and the degree of surface charge neutralization. All these factors work in concert to exemplify the overall performance of a photoconductor. The performance is typically measured in terms of sensitivity of the photoconductor to light exposure at a particular wavelength, with higher photosensitivities associated with enhanced PC performance. Additionally, the performance can be measured in terms of the rate of photodischarge of the photoconductor once illuminated with light of specific wavelength, with higher discharge rates associated with a better photoconductor.

A charge generation material (CGM) is incorporated in a photoconductor. Desired CGM characteristics include efficient absorption of light at the exposure wavelength, low recombination of initially-generated charges, the ability to produce free charges and transfer charges to transport material, and photostability. As such, both the optical/electronic properties of the CGM and manipulation of these properties through the choice of correct material and environment are key considerations. In addition, PCs are required to be manufactured in a cost-effective manner, so to reduce the overall cost of the printing device.

Current photoconductors utilize dyes such as diazo or phthalocyanine compounds and derivatives as CGM. These compounds are readily available and have been produced and used as CGMs in electrophotographic printer's photoconductors extensively.

SUMMARY OF THE INVENTION

Disclosed are embodiments of CGMs with increased photoresponse (resulting in higher printing speed), and higher photostability (resulting in longer lifetime).

Disclosed is photoconductor for an electrophotographic device comprising: at least one conductive layer and; an active region comprising at least one photoconductor layer comprising: a charge generation material (CGM) comprising a plurality of surface modified quantum dots, wherein the quantum dots are formed by depopulation of the organic ligands forming the capping layer of the quantum dots. The photoconductor device can further comprising the quantum dots comprising quantum dots selected from the group of: size-dependent quantum dots, composition-dependent quantum dots, core-shell quantum dots, alloyed core quantum dots, alloyed core-shell quantum dots, doped quantum dots, InP/ZnS core-shell quantum dots, CdS, CdSe, ZnS, ZnSe, GaN, GaP, InP, InN, PbSe, PbS, Ge, CuI, Copper Indium Disulfide (CIS), Si, CdSSe, and ZnS:Mn doped quantum dots. The photoconductor of can comprise: the conductive layer comprising a conductive substrate selected from the group of: aluminum plates and cylinders, a non-conductive substrate coated with a conductive material, aluminum-coated. Mylar or PET, and nickel-coated Mylar or PET. The conductive layer can comprise aluminum.

Described are embodiments of a method of forming surface modified quantum dots (QD) comprising: recovering a plurality of surface-depopulated QDs from a QD sample comprising a plurality of QDs each having an organic capping layer; and forming a QD photoconductor material including the surface-depopulated QDs for an electrophotographic device. The method can further comprise: recovering the surface-depopulated QDs by performing for one or more times the process comprising: dissolving the QD sample in a solvent to form a solvent mixture including QDs; precipitating the QDs in the solvent mixture; and separating and removing a liquid phase from the solvent mixture to obtain a surface-depopulated QD solid comprising the surface-depopulated QDs; forming a QD dispersion by mixing the surface-depopulated QD solid with a liquid; forming the QD photoconductor material from the QD dispersion.

Recovering the surface-depopulated QDs from the QD solid sample can further comprise: re-dissolving the solid QD sample in of a solvent; initiating the precipitation of the QD solids by adding a precipitant drop-wise to the solvent mixture; subjecting the QD sample to centrifugation to separate the solid and liquid phases of the sample; and removing the liquid phase from the mixture to afford the solid QD sample. Recovering the surface-depopulated QDs from the QD solid sample can further comprise: repeating the process of dissolution-precipitation-liquid phase removal from at least 2 to 12 times. The method can further comprise placing the solution comprising the plurality of QDs each having the organic capping layer dissolved in a solvent in an inert atmosphere for the recovery process; and removing the solvent mixture from the inert atmosphere prior to separating the liquid phase from the solvent. The method can further comprise storing the mixture in an inert atmosphere to allow full dispersion of QD solids in the liquid phase.

The method can further comprise: fabricating a quantum dot photoconductor (QDPC) device for the electrophotographic device from the QD photoconductor material. The fabrication can comprise preparing a substrate for QDPC layer deposition; forming a ground electrode on the substrate; and depositing a layer of the QDPC material on the substrate. Forming the QDPC can further comprise including the surface-depopulated QD solid with in solution of N,N'-Diphenyl-N,N'-di(3-tolyl)-4-benzidine (TPD) in the solvent to form a QD/TPD dispersion; and adding a polymer to the QD/TPD dispersion. The polymer can comprise polystyrene. The fabrication can further comprise: depositing a layer of the QDPC material on a substrate comprising aluminum. Forming of the ground electrode can comprise: deposing a 200 nm layer of aluminum on the substrate.

DETAILED DESCRIPTION OF THE EMBODIMENTS

Figure 1:
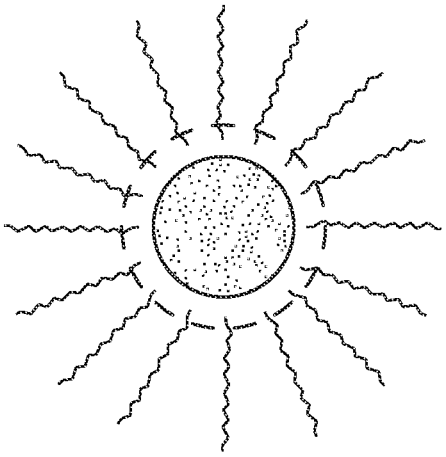
FIG. 1 depicts a 2-D pictorial of a quantum dot with an organic ligand capping layer.
Figure 2:
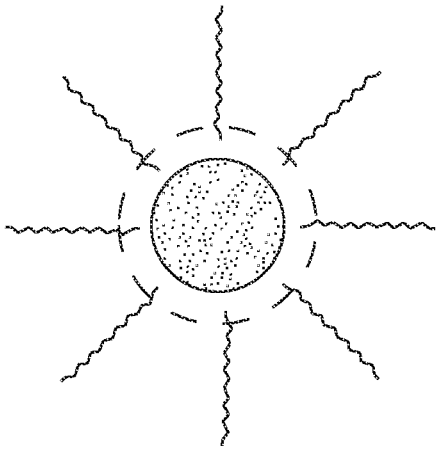
FIG. 2 exhibits the quantum dot of FIG. 1 following organic ligand depopulation.

Semiconductor quantum dots have attracted much attention due to their unique physical, chemical, electrical and optical properties. Much of the interest in optical and electrical characteristics stems from size-dependent properties owing to quantum confinement of charge carriers. This often results in the ability to "tune" the optical and electronic properties, specifically, light absorption, light emission, and the energetics involving charge generation and interaction, which can be modified through changing the size of quantum dots (QDs). Due to the aforementioned unique photonic and electronic nature, described herein quantum dots for photoconductors for electrophotography and for CGM in photoconductors for electrophotography.

Typical colloidal quantum dot compositions including the type used in this invention, consist of an active inorganic core, including but not limited to, for example InP, $CuInS_2$, and Si shrouded by a capping layer composed of high boiling point, long aliphatic chain organic ligands, for example myristic acid (MA). Examples of long aliphatic chain organic ligands include myristic acid, oleic acid, oleylamine, and oleamide, or organophosphorus compounds including trioctylphosphine oxide. The organic capping layer provides dispersability of the QD composition in various solvents and also acts as a stabilizing agent. The capping layer provides for solution-processing of the quantum dots and quantum dot formulations, and as such, it is an integral part of the colloidal system during initial processing steps. For instance, colloidal solution methods comprise co-injection of precursor solutions at moderate (<300° C.) temperatures, whereby QDs are formed via a "nucleation and growth" mechanism. Ligands forming the capping layer provide QD solubility for solution processing and QD stability in solution.

On the other hand, due to its large radius and electrically insulating nature, the capping layer provides a large barrier to charge transfer and transport, which may reduce the overall performance of the photoconductor. Therefore, disclosed are embodiments for modification of the surface of the QDs in a finalized QDPC for an eletrophotographic device to minimize or remove the aforementioned barrier.

In embodiments, removal of the capping layer from the surface of the quantum dots can provide for the neighboring quantum dots to have intimate contact so to maximize charge carrier transport and mobility, and also provide for the removal of energetic barrier to charge transfer from quantum dots to HTM.

In embodiments, removal may be accomplished through depopulation of the organic ligands forming the capping layer on the surface of the quantum dots by chemical means, as described herein. This depopulation may result in a decrease in inter-QD distance and also reduce the energetic barrier to QD to HTM charge transfer, hence enhancing both charge carrier mobility and charge transfer rate, respectively.

Modification of the QD surface through depopulation of the organic ligands forming the capping layer on the surface of the quantum dots can result in more efficient charge transfer from QD (CGM) to HTM. Also, electron transport through the network of quantum dots may be enhanced due to depopulation of long chain ligands that inhibit charge transport. Due to higher optical absorption cross-section, QDs can absorb more photons under equal illumination compared with conventional CGMs. This in turn will result in more efficient exciton generation in QDs. As a result, the optical power output of the exposure source need not be increased to increase the photoresponse. In addition, generation of free charge carriers and charge transfer to transport molecules is expected to be more efficient due to the direct relationship between size and the position of the QD energy levels. Finally, utilization of semiconductor quantum dots as electron transport material can provide for a quasi-solid state transport scheme that may result in higher electron mobility compared with conventional CGM.

Disclosed is a method for fabricating a photoconductor (PC) for an electrophotographic printing device. The photoconductor, designated hereafter as quantum dot photoconductor (QDPC), utilizes surface-modified semiconductor quantum dots (QD) as Charge Generation Material (CGM) within the photoconductor.

In embodiments, surface modification is achieved through depopulation of organic ligands forming the capping layer on the surface of quantum dots.

In general, a quantum dot photoconductor can exhibit enhanced performance compared with conventional organic photoconductor (OPC), including overall increase in printing speed and longer lifetime when integrated with an electrophotographic printing device. The performance enhancements arise due to intrinsically high optical absorption cross-section in quantum dots, manipulation of the position of electronic levels and energetics, a substantial presence of quasi solid-state charge transport, and intrinsically high photostability in an inorganic CGM as compared to an organic CGM. Further enhancement in performance is subsequently achieved through modification of the surface of QDs to afford more efficient charge transfer and charge transport. In embodiments, the photoconductor utilizes a "Single-Layer" architecture that includes conventional Hole Transport Material (HTM), the CGM (QD), additionally acting as Electron Transport Material (ETM), and a polymer. The aforesaid method of fabrication and implementation are applicable to a wide range of quantum dots, including size-dependent or composition-dependent QDs of varying sizes and compositions, core, core-shell, alloyed core, and alloyed core-shell quantum dots.

It is to be understood that the figures and descriptions of the present invention have been simplified to illustrate elements that are relevant for a clear understanding of the present invention, while eliminating, for purposes of clarity, many other elements which are conventional in this art. QDs have been explored for their electroluminescent properties with applications in optoelectronics, particularly, as active emitting layers in planar light emitting devices. Quantum dots have also been studied for use in photovoltaics, specifically as the active layer in solar cells. Examples of such quantum dot optoelectronic devices, applications, methods and elements thereof are described in U.S. Pat. Nos. 5,889,288; 5,923,046; 5,963,571; 6,281,519; 6,239,449; 7,282,732; 7,358,525; 7,791,157; 7,829,880; 8,164,083, U.S. patent application Ser. Nos. 13/190,884, and 13/565,297 the entirety of each of which are incorporated by reference herein.

Quantum dots exhibit desired characteristics for use as CGM in photoconductors. Typical colloidal quantum dot compositions including the type used in embodiments described herein, consist of an active inorganic core, for example InP or Si shrouded by an organic ligand capping layer, for example trioctylphosphine oxide (TOPO), or an active inorganic core encased by an inorganic shell, for example ZnS which is also shrouded by an organic ligand capping layer (core-shell structure). In general, core-shell structures possess increased stability and lower charge recombination rates due to elimination of the core surface defects by the shell moiety. The organic capping layer assists in enhancing the dispersability of the QD composition in various solvents and also acts as a stabilizing agent. As such, it is an integral part of the colloidal system during initial processing; however, as described herein it may be modified or removed afterward.

Conventional photoconductors utilize dyes such as diazo or phthalocyanine compounds and derivatives as CGM. These compounds are readily available and have been produced and used as CGMs in electrophotographic printer's photoconductors extensively. Due to higher optical absorption cross section, QDs are expected to absorb more photons under equal illumination compared with conventional CGMs. This in turn will result in more efficient exciton generation in QDs. As a result, the optical power output of the exposure source need not be increased to increase the photoresponse. Spectral tunability in quantum dots affords exact matching of the optical absorption profile/peak to the wavelength of the incoming light, without changing the composition of the CGM material.

In addition, generation of free charge carriers and charge transfer to transport molecules is expected to be more efficient due to the direct relationship between size and the position of the QD energy levels. The ability to control the QD surface will afford a path to enhancing charge generation and transfer as well. The above-mentioned enhancements can result in an overall improvement in photoconductor sensitivity, which in turn would translate to a higher printing speed. Also, due to their inorganic nature, semiconductor quantum dot CGMs can be more photostable compared with their organic CGM counterparts.

Those of ordinary skill in the art will recognize that other elements are desirable for implementing the present invention. However, because such elements are well known in the art, and because they do not facilitate a better understanding of the present invention, a discussion of such elements is not provided herein.

The use of the terms "a", "an", "at least one", "one or more", and similar terms indicate one of a feature or element as well as more than one of a feature. The use of the term "the" to refer to the feature does not imply only one of the feature and element.

When an ordinal number (such as "first", "second", "third", and so on) is used as an adjective before a term, that ordinal number is used (unless expressly or clearly specified otherwise) merely to indicate a particular feature, such as to distinguish that particular feature from another feature that is described by the same term or by a similar term.

When a single device, article or other product is described herein, more than one device/article (whether or not they cooperate) may alternatively be used in place of the single device/article that is described. Accordingly, the functionality that is described as being possessed by a device may alternatively be possessed by more than one device/article (whether or not they cooperate). Similarly, where more than one device, article or other product is described herein (whether or not they cooperate), a single device/article may alternatively be used in place of the more than one device or article that is described. Accordingly, the various functionality that is described as being possessed by more than one device or article may alternatively be possessed by a single device/article.

The functionality and/or the features of a single device that is described may be alternatively embodied by one or more other devices, which are described but are not explicitly described as having such functionality/features. Thus, other embodiments need not include the described device itself, but rather can include the one or more other devices, which would in those other embodiments, have such functionality/features.

The present invention will now be described in detail on the basis of exemplary embodiments.

Incorporation of the semiconductor quantum dots as CGM in place of conventional organic-based dyes or pigments in the photoconductor results in the aforementioned enhancements. The aforesaid methods of fabrication and implementation are applicable to a wide range of quantum dots, including size-dependent or composition-dependent QDs of varying sizes and compositions, core, core-shell, alloyed core, alloyed core-shell quantum dots and doped quantum dots.

Semiconductor quantum dots (QD) have unique physical, chemical, electrical and optical properties. Optical and electrical characteristics of QDs stem from size-dependent properties owing to quantum confinement of charge carriers. This often results in the ability to "tune" the optical spectrum and specifically, both the light absorption and emission responses through changing the size of the QD.

Disclosed are embodiments of a photoconductor comprising: at least one conductive layer and; an active region comprising at least one photoconductor layer comprising a charge generation material (CGM) comprising a plurality of quantum dots. The device can further comprise the quantum dots, examples of which include quantum dots selected from: size-dependent quantum dots, composition-dependent quantum dots, core-shell quantum dots, alloyed core quantum dots, alloyed core-shell quantum dots, InP/ZnS core-shell quantum dots, CdS, CdSe, ZnS, ZnSe, GaN, GaP, InP, InN, PbSe, PbS, Ge, CuI, Copper Indium Disulfide (CIS), Si, CdSSe, and ZnS:Mn doped quantum dots. The quantum dots may be of core or core/shell structure, and include a layer of organic ligands on the surface to facilitate solution processing and dispersion stability, these ligands being processed as described in embodiments herein.

The photoconductor can also comprise materials selected from the group of materials including:

1. Hole Transport Material (HTM), examples of which include but are not limited to: N,N'-Bis(3-methylphenyl)-N,N'-diphenylbenzidine, N,N'-Di-[(1-naphthyl)-N,N'-diphenyl]-1,1'-biphenyl)-4,4'-diamine, Tetra-N-phenylbenzidine, Tris[4-(diethylamino)phenyl]amine, N,N-diethylaminophenylbenzaldehyde-diphenylhydrazone, and other substituted Hydrazones.

2. Electron Transport Material (ETM), examples of which include but are not limited to: Bathocuproine, Bathophenanthroline, 2,5-Bis(1-naphthyl)-1,3,4-oxadiazole, 3,5-Bis(4-tert-butylphenyl)-4-phenyl-4H-1,2,4-triazole, and Tris-(8-hydroxyquinoline)aluminum.

3. Polymeric Material including a Polymer Matrix (PM) and/or Resins, examples of which include but are not limited to: Bisphenol-A-polycarbonate, Poly(methyl methacrylate), Polystyrene, Polyvinyl butyral, Polyester, and Polycarbonate-Z.

In embodiments disclosed herein, a photoconductor includes semiconductor quantum dots as its CGM.

Figure 3A:
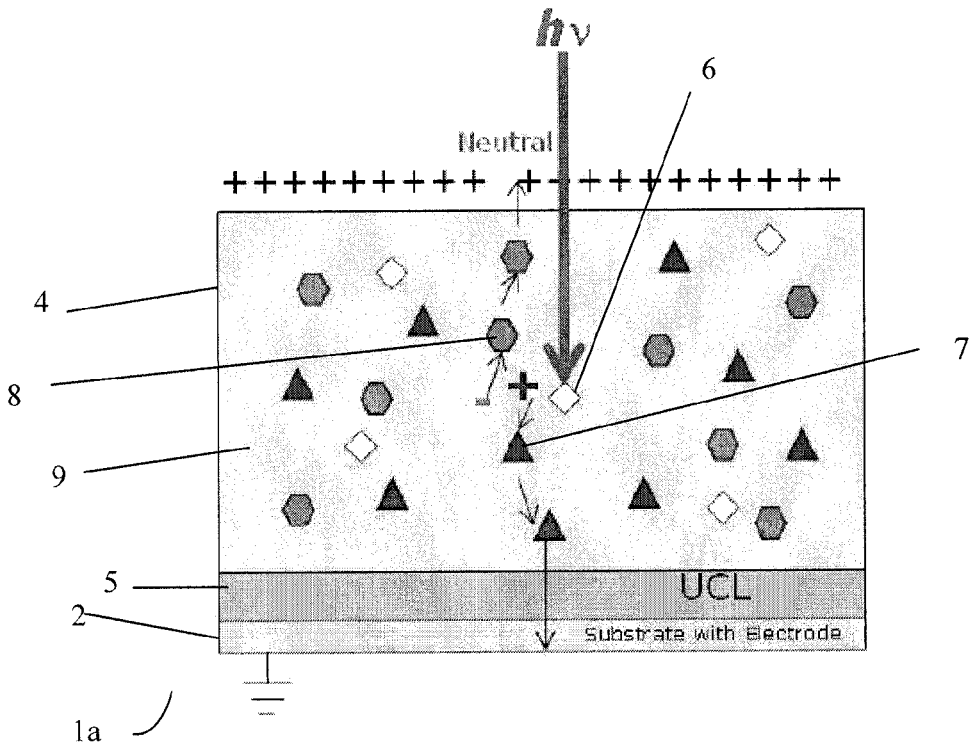
FIGS. 3A and 3B depict the general architecture of the QDPC device.

FIG. 3A depicts a schematic of an exemplary embodiment of a QDPC device 1*a*. In this embodiment, the QDPC 1*a* comprises a substrate comprising at least one electrical conducting layer 2, and an active region comprising at least one photoconductor layer 4 comprising quantum dots 6. Also shown is an optional undercoat layer 5.

The architecture includes an active region that may comprise at least one photoconductor layer that comprises CGM including quantum dots 6 within the device. The photoconductor's active region may also comprise a CTM 7, 8 within the device, for example, embedded within the active layer(s) 4. Illumination of the device 1 with light having a specific wavelength range results in generation of electron-hole pairs (excitons) within the active layer 4. Once generated, the excitons may diffuse through the active layer 4 and arrive at an interface (not shown) where the electrons and the holes can be separated.

Figure 3B:
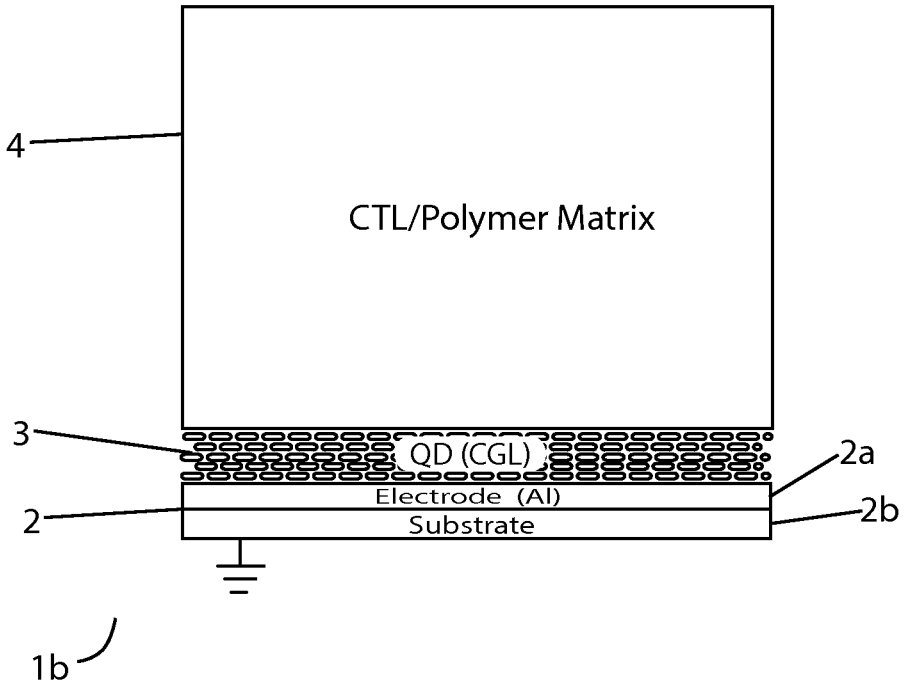

FIG. 3B depicts a general schematic of an exemplary dual-layer QDPC device 1*b*. In this embodiment, the QDPC 1*b* includes, the substrate comprising at least one electrical conducting layer 2, and an active region comprising a plurality of photoconductor layers 3, 4 including a charge generation layer (CGL) 3 comprising quantum dots and a charge transfer layer (CTL) 4 including charge transfer materials. The electrical conducting layer 2 can comprise a substrate made of a conductive material, or as shown in the embodiment, the electrical conducting layer 2 can comprise a substrate 2*b* that may not itself be conductive (e.g., glass or Mylar or PET) but is coated with conductive material 2*a* such as aluminum or nickel to render it conductive. The conductive substrate can be formed by techniques known in the art, for example, e-beam or thermal evaporation. An optional undercoat layer (not shown) may also be included.

EXAMPLE 1

FIG. 1A depicts a 2-D pictorial of a quantum dot with organic ligand capping layer.

FIG. 1B exhibits the quantum dot of FIG. 1 following organic ligand depopulation through the methodology described below for the exemplary device.

Fabrication of the Exemplary Devices

Disclosed are embodiments of the exemplary photoconductor devices utilizing surface-modified quantum dots as charge generation material (CGM). Surface modification of the QDs is achieved through depopulation of the organic ligands forming the capping layer on the surface of the quantum dots.

In an embodiment, Example 1A to prepare the QDPC formulation for the exemplary device, 100 μl of a solution of 25 mg/ml InP core QD sample in chloroform (with optical absorption onset of about 630 nm) having an organic capping layer was placed in an inert atmosphere—the present Example being a glass vial inside an inert atmosphere glove box. The solvent was evaporated, affording 2.5 mg of QD solid sample.

The solid QD sample re-dissolved in 0.5 ml of chloroform, and 1.0 ml of methanol was added drop-wise to the dispersion to initiate precipitation of the QD solids. Following precipitation of the QDs in the solvent mixture, the vial containing the mixture was capped and removed from the glove box to ambient, and the sample was subjected to centrifugation at 4000 rpm for 120 minutes, resulting in full separation of solid and liquid phases. The liquid phase was then removed from the mixture, affording the solid QD. The process of dissolution-precipitation-liquid phase removal which is responsible for removal of ligands from the capping layer was repeated 2-8 additional times, following which the surface-depopulated QDs were recovered. As will be appreciated the dissolution-precipitation-liquid phase removal can be repeated any number of times, for example at least 2 to 12 times. The surface-depopulated QD solid was mixed with a 0.16 ml solution of N,N'-Diphenyl-N,N'-di(3-tolyl)-4-benzidine (TPD) in chloroform (105 mg/ml), and the mixture was stored in the glove box for 5-24 hours to allow full dispersion of QD solids in the liquid phase. Next, 0.29 ml of a 90 mg/m1 solution of polystyrene (PS) in chloroform was added to the QD/TPD dispersion and stirred. Additionally, 0.05 ml of chloroform was added to the mixture and stirred, providing the QDPC formulation.

To prepare a substrate for QDPC layer deposition, a 75 mm×25 mm×1 mm glass slide was cleaned by ultrasonication in an isopropyl alcohol bath for 60 minutes and dried. A ground electrode was formed on the glass substrate through deposition of a 200 nm layer of aluminum (99.998%) on the glass slide via e-beam evaporation. The aluminum-deposited glass slide was then removed from the evaporator and used for QDPC device fabrication.

An exemplary QDPC device was fabricated by depositing a layer of QDPC on the aluminum-coated substrate utilizing the above-mentioned QDPC formulation. QDPC layer deposition was performed through blade-coating to afford an about 20 μn QDPC layer following drying in ambient conditions for 3-24 hours. The device was then placed in a photo-induced discharge measurement apparatus to characterize its performance. Typical photo-induced discharge characterization (PIDC) measurements were performed at an initial surface potentials of +1000 V and 750V obtained by charging the PIDC with a Corona charger and illumination at a wavelength of 600 nm using light generation from the light generation components of a Fluorescence spectrometer. Measurements were taken using a detection device including transparent probe and an electrostatic volt meter device coupled to computer software configured for the measurements.

Fabrication of the Comparative Device

A comparative device was fabricated to confirm performance enhancement in the exemplary device. For the standard device, a sample of InP core QD with the same initial characteristics was utilized; however, the QD sample was not subjected to depopulation of the organic ligands forming the capping layer on the surface of the quantum dots. In order to perform a valid comparison between the exemplary and the comparative device, all parameters, materials, and mixtures were kept identical.

Accordingly, to prepare the QDPC formulation for the standard comparative device, 100 μl of a solution of 25 mg/ml InP core QD sample in chloroform (with optical absorption onset of about 630 nm) having an organic capping layer was placed in a glass vial inside an inert atmosphere glove box.

The solvent was evaporated, affording 2.5 mg of QD solid sample. However, the QD sample was not subjected to depopulation of the organic ligands forming the capping layer on the surface of the quantum dots. The QD solid was mixed with a 0.16 ml solution of N,N'-Diphenyl-N,N'-di(3-tolyl)-4-benzidine (TPD) in chloroform (105 mg/ml), and the mixture was stored in the glove box for 5-24 hours to allow full dispersion of QD solids in the liquid phase. Next, 0.29 ml of a 90 mg/ml solution of polystyrene (PS) in chloroform was added to the QD/TPD dispersion and stirred. Additionally, 0.05 ml of chloroform was added to the mixture and stirred, providing the QDPC formulation.

Accordingly, the same amounts of QD, TPD, and PS were used to afford the QDPC formulation for the standard device. The type of substrate and the method for deposition of the QDPC formulation for the standard device remained the same as well. Performance measurements were conducted using the same methodology as the previous example.

Example 1A as well as further Examples 1B and 1C of surface modified QDs achieved through depopulation of the organic ligands forming the capping layer on the surface of the quantum dots as shown above are given in Table 1. Samples of 200 μl of a solution of 25 mg/ml InP core QD sample were similarly processed to afford 5.0 mg of QD solid sample Examples 1B and 1C. The samples were similarly processed as given above.

TABLE 1

| | Component Mass (mg) | | | Component Ratio | | |
|---|---|---|---|---|---|---|
| Example | QD | HTM | Polymer | QD | HTM | Polymer |
| Example 1A E1A | 2.5 | 17 | 26 | 0.055 | 0.374 | 0.571 |
| Example 1B E1B | 5.0 | 17 | 26 | 0.104 | 0.354 | 0.542 |
| Example 1C E1C | 5.0 | 22 | 21 | 0.104 | 0.458 | 0.438 |

Figure 4A:
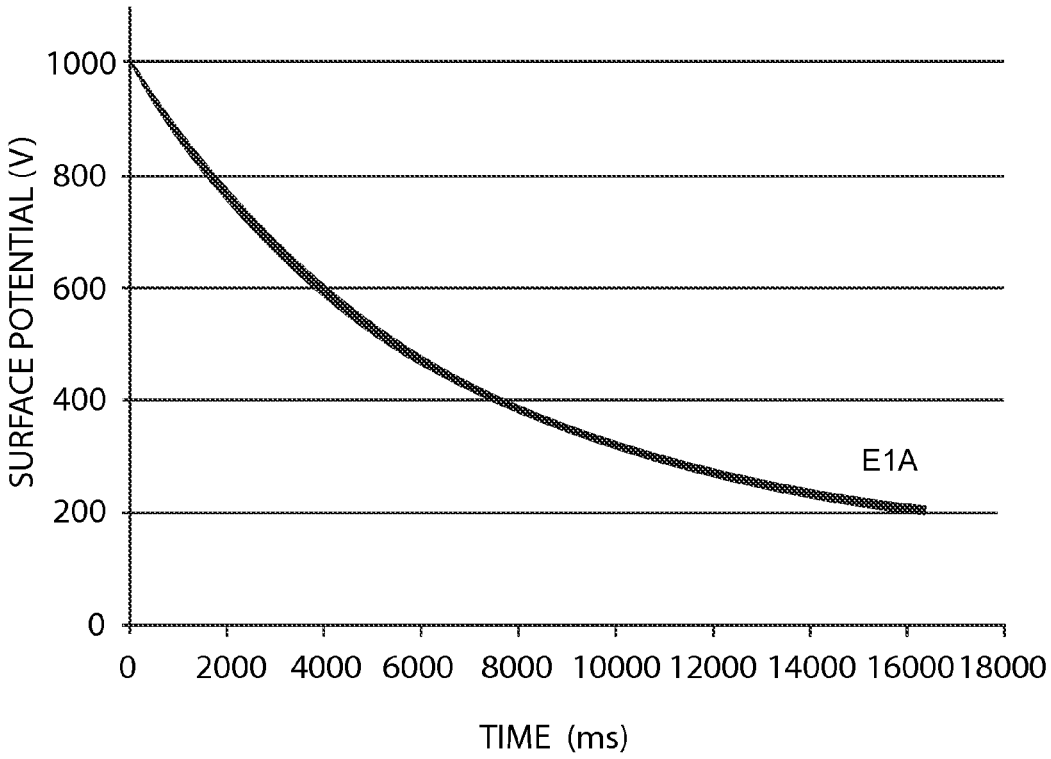
FIGS. 4A-4C exhibits the photo-induced discharge characteristic (PIDC) of embodiments of an exemplary device.

FIG. 4A is a graph showing surface potential (V) over time of the exemplary device including showing the photo-induced discharge characteristic (PIDC) of the exemplary embodiment of the device for Example 1A E1A. The initial surface potential is charged by a Corona charger to +1000 V, and the device was illuminated with 600 nm monochromatic light. As shown in FIG. 4A, the surface potential drops from +1000 V to 200 V in 16,000 ms, with an exponential drop of about three quarters of that reduction occurring in about half that time (from +1000 V to 400V in 8000 ms).

Figure 4B:
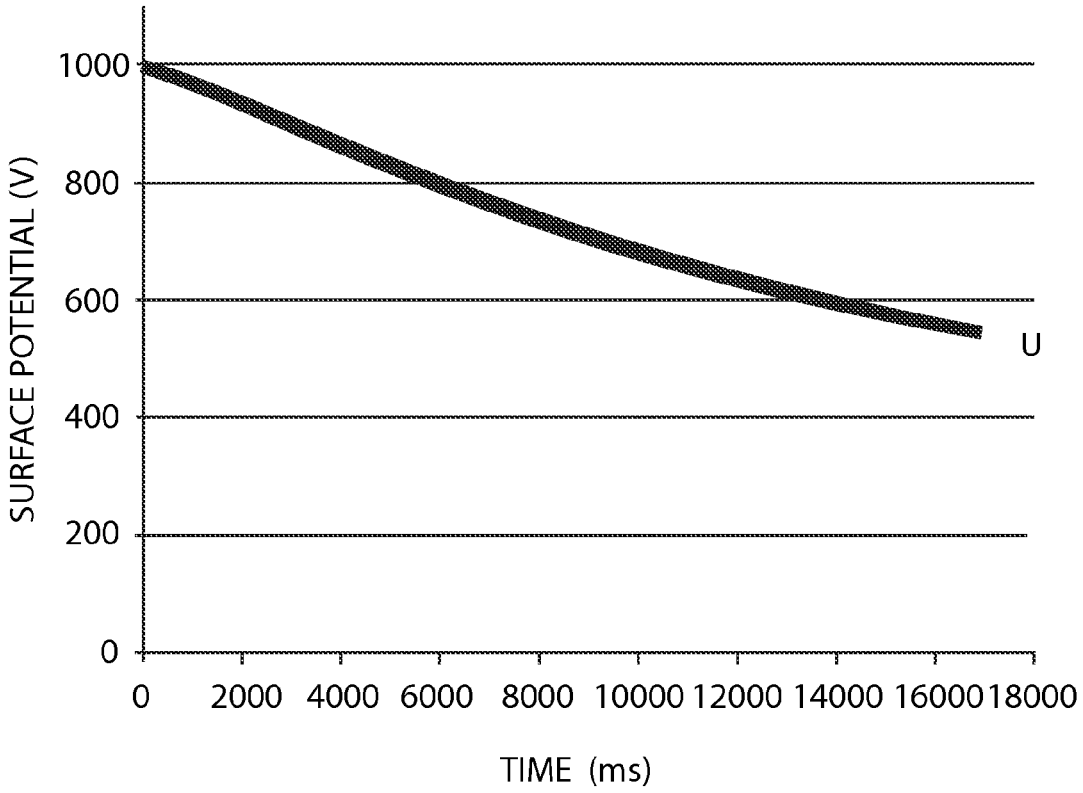

FIG. 4B depicts the PIDC of the device where the QDs are unmodified U. Initial surface potential is at +1000 V, and the device was illuminated with 600 nm monochromatic light. However in the same amount of time the surface potential dropped from +1000 to just under 600 V, and the rate of drop being a substantially a regular slope. Thus the exemplary embodiment shows, inter alia, an exponentially increased photoresponse over the standard device.

Figure 4C:
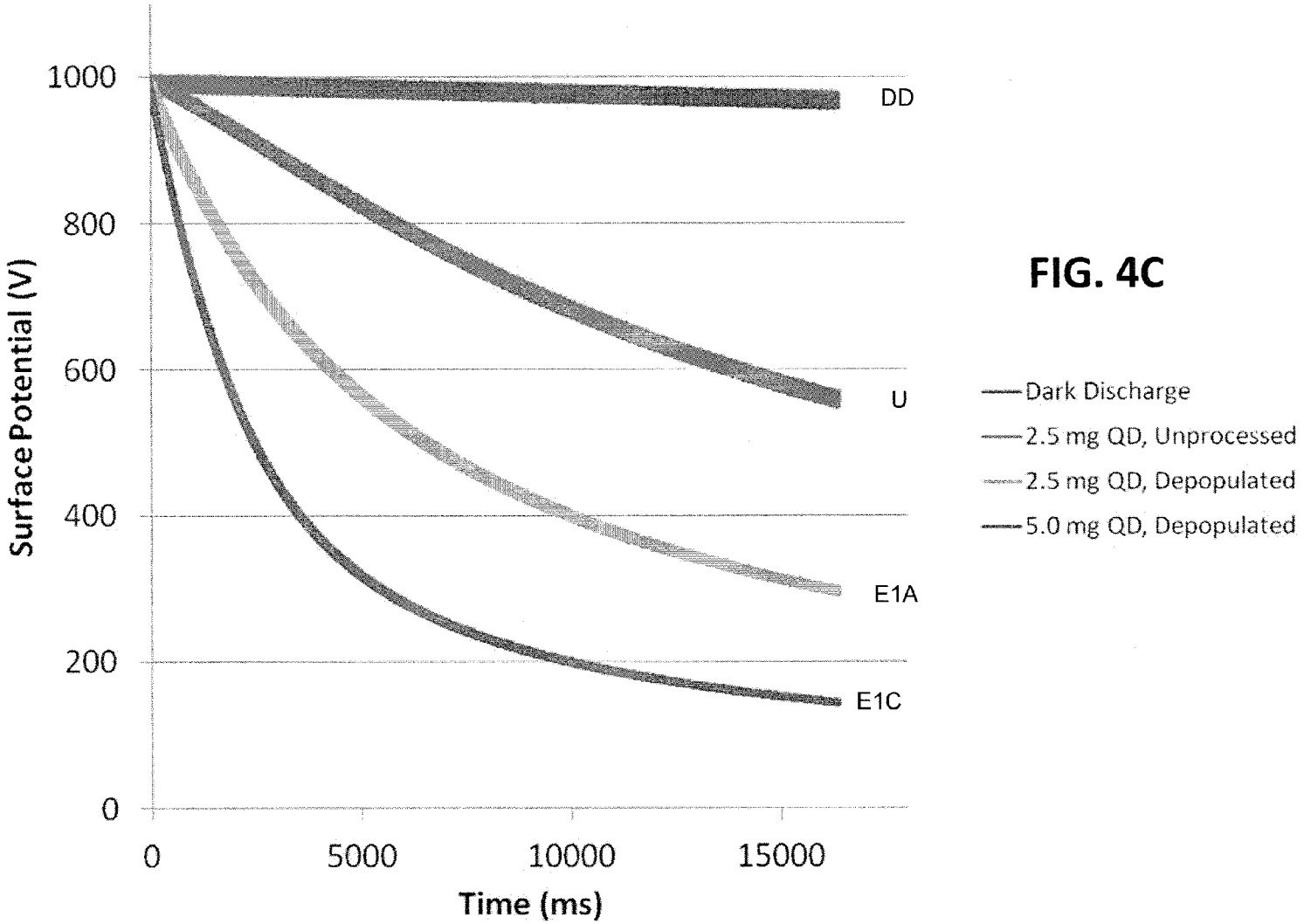

FIG. 4C depicts the PIDC of exemplary comparative devices comprising quantum dots where the capping layer comprising depopulated quantum dots for Examples 1A E1A and the device with the unmodified quantum dots U as shown FIGS. 4A and 4B respectively as compared to the device comprising depopulated QDs of Example 1C E1C. Initial surface potential is at +1000 V, and the device was illuminated with 600 nm monochromatic light. As will be noted, Example 1C E1C including 5.0 mg of InP QDs shows an even faster photoresponse than the other exemplary embodiments, dropping to about 300V in about 5 seconds. FIG. 4C also shows the Dark Discharge characteristic of the QDPC, and in particular shows the QDPC has high charge retention during a dark cycle and further shows the strong degree of the rate of the photodischarge when illuminated.

Although exemplary embodiments of the present invention and modifications thereof have been described in detail herein, it is to be understood that this invention is not limited to these precise embodiments and modifications, and that other modifications and variations may be effected by one skilled in the art without departing from the spirit and scope of the invention as defined by the appended claims.

What is claimed is:

1. A photoconductor for an electrophotographic device comprising:
- at least one conductive layer and;
- an active region comprising at least one photoconductor layer comprising:
  - a charge generation material (CGM) comprising a plurality of surface modified quantum dots, wherein the quantum dots are formed by depopulation of the organic ligands forming the capping layer of the quantum dots.

2. The photoconductor of claim 1, the device further comprising:
- the quantum dots comprising quantum dots selected from the group of:
- size-dependent quantum dots, composition-dependent quantum dots, core-shell quantum dots, alloyed core quantum dots, alloyed core-shell quantum dots, doped quantum dots, InP/ZnS core-shell quantum dots, CdS, CdSe, ZnS, ZnSe, GaN, GaP, InP, InN, PbSe, PbS, Ge, CuI, Copper Indium Disulfide (CIS), Si, CdSSe, and ZnS:Mn doped quantum dots.

3. The photoconductor of claim 1 comprising:
- the conductive layer comprising a conductive substrate selected from the group of:
  - aluminum plates and cylinders, a non-conductive substrate coated with a conductive material, aluminum-coated Mylar or PET, and nickel-coated Mylar or PET.

4. The photoconductor of claim 3 wherein the conductive layer comprises aluminum.

5. A method of forming surface modified quantum dots (QD) comprising:
- recovering a plurality of surface-depopulated QDs from a QD sample comprising a plurality of QDs each having an organic capping layer; and
- forming a QD photoconductor material including the surface-depopulated QDs for an electrophotographic device.

6. The method of claim 5, further comprising:
- recovering the surface-depopulated QDs by performing for one or more times the process comprising:
  - dissolving the QD sample in a solvent to form a solvent mixture including QDs;
  - precipitating the QDs in the solvent mixture; and
  - separating and removing a liquid phase from the solvent mixture to obtain a surface-depopulated QD solid comprising the surface-depopulated QDs;
- forming a QD dispersion by mixing the surface-depopulated QD solid with a liquid;
- forming the QD photoconductor material from the QD dispersion.

7. The method of claims 5 or 6 further comprising:
- fabricating a quantum dot photoconductor (QDPC) device for the electrophotographic device from the QD photoconductor material.

8. The method of claim 7, the fabrication comprising:
- preparing a substrate for QDPC layer deposition;

forming a ground electrode on the substrate;

depositing a layer of the QDPC material on the substrate.

9. The method of claim 8, wherein forming the QDPC further comprises:

including the surface-depopulated QD solid with in solution of N,N'-Diphenyl-N,N'-di(3-toly1)-4-benzidine (TPD) in the solvent to form a QD/TPD dispersion; and adding a polymer to the QD/TPD dispersion.

10. The method of claim 9 further comprising:

storing the mixture in an inert atmosphere to allow full dispersion of QD solids in the liquid phase.

11. The method of claim 9 wherein the polymer comprises polystyrene.

12. The method of claim 8, the fabrication comprising:

depositing a layer of the QDPC material on a substrate comprising aluminum.

13. The method of claim 12, the forming of the ground electrode comprising:

deposing a 200 nm layer of aluminum on the substrate.

14. The method of claim 6, wherein recovering the surface-depopulated QDs from the QD solid sample further comprises:

re-dissolving the solid QD sample in of a solvent;

initiating the precipitation of the QD solids by adding a precipitant drop-wise to the solvent mixture;

subjecting the QD sample to centrifugation to separate the solid and liquid phases of the sample; and removing the liquid phase from the mixture to afford the solid QD sample.

15. The method of claim 6, wherein recovering the surface-depopulated QDs from the QD solid sample further comprises:

repeating the process of dissolution-precipitation-liquid phase removal from at least 2 to 12 times.

16. The method of claim 6, further comprising:

placing the solution comprising the plurality of QDs each having the organic capping layer dissolved in a solvent in an inert atmosphere for the recovery process; and removing the solvent mixture from the inert atmosphere prior to separating the liquid phase from the solvent.

* * * * *